US011634949B2

(12) United States Patent
Völkel et al.

(10) Patent No.: US 11,634,949 B2
(45) Date of Patent: Apr. 25, 2023

(54) PERCUSSION BORING DEVICE AND METHOD FOR REVERSING A PERCUSSION BORING DEVICE

(71) Applicant: TRACTO-TECHNIK GmbH & Co. KG, Lennestadt (DE)

(72) Inventors: Gerhard Völkel, Erndtebrück (DE); Gerhard Balve, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 368 days.

(21) Appl. No.: 15/197,313

(22) Filed: Jun. 29, 2016

(65) Prior Publication Data

US 2017/0002607 A1 Jan. 5, 2017

(30) Foreign Application Priority Data

Jul. 1, 2015 (DE) ..... 102015008339.2

(51) Int. Cl.
*E21B 4/14* (2006.01)
*E21B 10/36* (2006.01)
*E21B 7/18* (2006.01)

(52) U.S. Cl.
CPC ..... *E21B 4/145* (2013.01)

(58) Field of Classification Search
CPC ..... E21B 4/145
USPC ..... 173/90, 213
See application file for complete search history.

(56) References Cited

U.S. PATENT DOCUMENTS 4,214,638 A * 7/1980 Sudnishnikov ..... E02D 7/10 173/1
4,221,157 A * 9/1980 Schmidt ..... E21B 4/145 91/416
4,530,408 A * 7/1985 Toutant ..... E21B 4/14 173/136
4,840,237 A * 6/1989 Roemer ..... E21B 4/145 173/91
5,050,686 A * 9/1991 Jenne ..... E21B 4/145 173/91

(Continued)

FOREIGN PATENT DOCUMENTS

DE 69124461 T2 5/1997
EP 0484839 A2 5/1992

(Continued)

*Primary Examiner* — Thomas M Wittenschlaeger
*Assistant Examiner* — David G Shutty
(74) *Attorney, Agent, or Firm* — Howard IP Law Group, PC

(57) ABSTRACT

A percussion boring device comprising a casing, a guide tube fixed to the casing, and a control bushing axially displaceable on the guide tube. An impact piston of the device is axially displaceable on the control bushing and configured to be actuated in a reciprocating manner within the casing such that in a first switching position the impact piston strikes a front impact surface to actuate the percussion boring device in a first movement direction, and in a second switching position a rear impact surface to actuate the percussion boring device in a second movement direction. A pressure increasing means is provided and configured to generate a pressure for reversing the percussion bore device, wherein the generated pressure is higher than a pressure for moving the impact piston. The guide tube and the control bushing are configured to reverse movement directions of the impact piston.

14 Claims, 2 Drawing Sheets

(56) References Cited

U.S. PATENT DOCUMENTS 5,056,608 A * 10/1991 Hemmings ..... E21B 4/145 173/91
5,086,848 A * 2/1992 Hudak ..... E21B 4/145 173/91
5,148,878 A * 9/1992 Schmidt ..... E21B 4/145 173/91
5,172,771 A * 12/1992 Wilson ..... E21B 4/145 173/91
5,226,487 A * 7/1993 Spektor ..... E21B 4/145 173/133
5,307,883 A * 5/1994 Jenne ..... E21B 4/145 173/91
5,311,950 A * 5/1994 Spektor ..... E21B 4/145 173/137
5,327,636 A * 7/1994 Wilson ..... E21B 4/145 173/91
5,467,831 A * 11/1995 Spektor ..... E21B 4/14 175/57
5,505,270 A * 4/1996 Wentworth ..... E21B 4/145 173/1
5,954,145 A * 9/1999 Hesse ..... E21B 4/145 173/91
5,960,892 A * 10/1999 Balve ..... E21B 4/145 173/91
6,050,347 A * 4/2000 Jenne ..... E21B 4/14 173/17
6,371,220 B1 * 4/2002 Hesse ..... E21B 4/145 173/91
6,406,215 B1 * 6/2002 Balve ..... E21B 4/145 285/305
6,467,554 B1 * 10/2002 Millican ..... E21B 4/145 173/91
6,551,066 B2 * 4/2003 Saylor ..... F04B 41/02 417/234
6,953,095 B2 * 10/2005 Randa ..... E21B 4/145 173/91
7,694,749 B2 * 4/2010 Sorric ..... B25D 17/32 173/171
7,874,382 B2 * 1/2011 Puttmann ..... E21B 7/26 173/91
9,016,404 B2 * 4/2015 Puttmann ..... E21B 4/145 173/17
9,033,065 B2 * 5/2015 Viitaniemi ..... E21B 44/02 175/27
9,193,046 B2 * 11/2015 Landrum ..... F16K 37/0041
9,353,739 B2 * 5/2016 Wilson ..... F04B 41/06
9,441,419 B2 * 9/2016 Spektor ..... E21B 4/145
9,938,769 B2 * 4/2018 Puttmann ..... E21B 4/145
2006/0207794 A1 * 9/2006 Spektor ..... E21B 4/145 175/19
2006/0243455 A1 * 11/2006 Telfer ..... E21B 34/14 166/318
2007/0240890 A1 * 10/2007 Sorric ..... B25D 9/04 173/31
2008/0003111 A1 * 1/2008 Turan ..... F04B 39/16 417/234
2008/0257609 A1 * 10/2008 Puttmann ..... E21B 7/26 175/296
2012/0097449 A1 * 4/2012 Viitaniemi ..... E21B 44/02 175/27
2012/0228031 A1 * 9/2012 Puttmann ..... E21B 4/145 175/61
2013/0025936 A1 * 1/2013 Puttmann ..... E21B 17/03 175/19
2013/0177452 A1 * 7/2013 Wilson ..... F04B 41/06 417/62
2014/0033876 A1 * 2/2014 Landrum ..... F15B 11/15 81/57.44
2015/0075157 A1 * 3/2015 Gresser ..... F15B 11/032 60/560
2016/0040481 A1 * 2/2016 Spektor ..... E21B 7/26 175/19
2017/0002607 A1 * 1/2017 Volkel ..... E21B 4/145

FOREIGN PATENT DOCUMENTS

GB 1 356 022 A 6/1974
PL 165305 B1 12/1994
PL 174742 B1 9/1998
WO 2005002801 A1 1/2005

* cited by examiner

PERCUSSION BORING DEVICE AND METHOD FOR REVERSING A PERCUSSION BORING DEVICE

CROSS-REFERENCE TO RELATED APPLICATIONS

This application claims priority to German Application No. 10 2015 008 339.2 filed Jul. 1, 2015 as required by 35 U.S.C. 119(b) and 37 CFR 1.55, the entirety of which application is hereby incorporated herein by reference for all purposes.

FIELD OF INVENTION

The invention relates to a percussion boring device and to a method for reversing a percussion boring device.

BACKGROUND

Percussion boring devices, as used in particular to create horizontal boreholes in the ground, are typically actuated by an impact piston moving in an oscillatory fashion inside the casing and thereby striking a front or rear impact surface of the casing depending on the desired movement direction of the device. The transferred kinetic energy of the impact piston causes an acceleration of the percussion boring device in the soil.

In general such a reversal or switching of the movement direction is obtained by shifting the center position (between the two reversal points) of the impact piston from a forward position to a rear position—or vice versa. In this way, the impact piston strikes either the front or the rear impact surface and thus defines the movement direction of the device.

Different embodiments for shifting the center position of the impact piston and thus altering the movement direction of the device are known from the prior art.

Usually, a guide bushing fixedly arranged (disposed) inside the casing, and a control bushing, which is axially displaceable on the guide bushing on which the impact piston is axially displaceable, are used for controlling the movement direction. The control bushing can be moved axially, for instance, by means of a rotational movement of the control sleeve, which is carried out by means of a rotation of a control sleeve connected to the pressure air hose. Due to the small volume, actuation by means of rotating the compressed air hose is particularly suitable for an earth boring device having a small diameter, as opposed other ways of reversing. A manual actuation by means of rotating the compressed air hose becomes more difficult with increasing length of the well bore, however.

The problem addressed by the invention is therefore the creation of an improved percussion boring device, which provides a simplified actuation of the reversal for percussion boring devices in longer bore holes.

This problem is solved by the subject matter of the independent claims. Advantageous embodiments are specified in the dependent claims.

The central idea of the invention is to renounce the standard idea of providing the same pressure for the reversal that is used for operating the device, and to apply pressure that is elevated relative to the pressure used for operation. The inventors have broken new ground by utilizing the amount of a previously inexistent pressure for reversing.

The invention provides a percussion boring device having a cyclically actuated reciprocating impact piston mounted inside a casing. In a first switching position, the impact piston strikes a front impact surface, to actuate the percussion boring device in a first movement direction. In a second switching position the impact piston strikes a rear impact surface, to actuate the percussion boring device in a second movement direction. For the reversal or switching between the two movement directions, the percussion boring device has a guide tube fixed to the casing and a control bushing axially displaceable on the guide tube. The impact piston can be axially displaced on the control bushing. The percussion boring device further comprises pressure increasing means, by which a pressure for reversing the percussion boring device can be generated, which is higher than the pressure for moving the impact piston.

The term "pressure increasing means" according to the invention comprises means suitable for applying a higher pressure to a fluid than required for moving the impact piston. An increase can be seen in the fact that a pressure generating means is used, which is "oversized" for the pure movement of the impact piston, and is primarily designed with respect to the amount of pressure applied to a reversal of the percussion boring device. The term "pressure increasing means" also includes an additional pressure medium source, which is present in addition to the pressure medium source required for the movement of the impact piston. The term "pressure increasing means" also includes means for increasing the pressure required for moving the impact piston, which is provided by means of a pressure medium source, so that the pressure required for reversing is applied; pressure increasing means and pressure boosters can, for instance, have pistons having different area ratios.

The fluid can be either a pressurized gas, in particular compressed air, or a liquid, i.e. the switching can be conducted pneumatically or hydraulically from the switching position before extending the control bushing from the annular space into the switching position by extending control bushing from the annular space.

In a preferred embodiment, an annular space at least partially covered at the front by the control bushing is formed between the guide tube and a ring member. The annular space is connected to a control line pressurizable by a fluid, to apply pressure to the control bushing for reversal purposes.

In a preferred embodiment, due to the pressure increasing means, a pressure for reversing of approximately 5 to approximately 25 bar, in particular approximately 7 to approximately 25 bar, can be generated. The required pressure increase depends on the pressurizable area ratios in the percussion boring device. In this way, a reversal between the movement directions can be executed for percussion boring devices having a small diameter by exerting corresponding pressure on the area of the control bushing projecting into the annular area.

In a preferred embodiment, a directional control valve is disposed downstream of the pressure increasing means. The directional valve can be used to turn on the control pressure in one position and to vent it in a different position. In this way a control system can be achieved using simple means; a three-way valve may be used, for instance. In a preferred embodiment, a directional control valve is disposed upstream of the pressure increasing means. By this means, it is possible to avoid subjecting the directional valve to the high pressure. Connecting the directional valve upstream in relation to the pressure increasing means also permits controlling the feed to a non-automatically operating pressure increasing means or the pressure booster. The directional control valve, which can be configured for example as a 3-way, 2-position directional valve, can thus be disposed in the feed direction upstream or downstream of the pressure increasing means and pressure booster.

In a preferred embodiment, the pressure increasing means are connected to the impact piston and a pressure-reducing valve is connected between the pressure increasing means and the impact piston. The pressure medium source required for the movement of the impact piston is thus amply dimensioned, and the pressure is reduced for the movement of the impact piston.

In a preferred embodiment, the control bushing at the guide tube is also guided with respect to a rotational movement, so that in addition to the axial displacing movement imposed thereon, there may also be a rotation of the control bushing in relation to the guide tube.

SUMMARY

The present invention also provides a method for reversing the movement direction of a percussion boring device having an impact piston cyclically actuated for reciprocation purposes. To this end, the reversal is executed by pressurization, a higher pressure than the pressure for moving the impact piston being selected.

Preferably, the method may be configured such that the control bushing can be brought into at least one intermediate position between two end positions. The control bushing can be brought into an intermediate position between two end positions by setting a predetermined pressure (pressure control) or a predetermined volume (volume control). In this way, the control bushing can be positioned by selecting a predetermined pressure or predetermined volume in at least one or any number of intermediate positions. This way, the intensity and/or frequency of impact of the impact piston on an impact surface of the casing of the percussion boring device can be adjustable. End positions of the control bushing are in particular defined by a stop of the control bushing and the mechanical blocking or prevention of further movement of the control bushing, in particular by means of a stop. In the intermediate position(s), the control bushing does not necessarily abut a stop, but the set pressure or the set volume results in a balance of the forces acting on the control bushing, i.e. the control bushing can be held in position relative to the guide tube. By applying a predetermined pressure or a predetermined volume, the control bushing can be brought into an (intermediate) position in a stable equilibrium. Volume control can be realized by a diverting valve, in particular a three-way valve. For instance, a predetermined quantity of fluid or a predetermined volume, preferably (compressed) air, can be introduced into the annular space, permitting the control bushing to assume a predetermined position. If a predetermined volume has entered the annular space, the supply of further fluid can be interrupted. The amount of fluid can depend on time, distance and/or quantity.

The control bushing can have at least two sections, in particular in the longitudinal direction, which are interconnected by means of a movable connection. In this way an increased length of the control bushing can be realized and the mobile connection will prevent a plastic deforming or re-shaping action on the control bushing. The movable connection can have a function corresponding to a loose bearing for one of the two sections of the control bushing. In particular, the section might not be in contact with the guide tube, in particular when it is spaced apart from the movable connection. The movable connection can form a plain bearing for one of the two sections and a loose bearing for the other of the two sections. The movable connection may be mounted on the guide tube to execute the axial displaceability of the guide tube, and also to permit a pivoting of a section of the guide tube. In this way, the control bushing can have a long length and the impact piston does not act upon the control bushing when it moves, for instance by distorting the control bushing, thereby reducing the life of the control bushing, which would result in increased repair and/or maintenance costs.

The connection of the two sections of the control bushing by means of movable connection can be done either directly or indirectly via the connection. Additional sections may be provided, for instance, between an elastic connecting section and/or a joint as a mobile connection and the two sections. Further, the control bushing is not limited to the two sections having a connecting section and/or a joint. In addition to the two sections and the connecting section and/or the joint, additional sections of the control bushing may be provided.

A "percussion boring device" according to the invention comprises a self-propelled impact device, which works by displacing soil, and can penetrate a pipe or tube into the ground by striking them. The term "soil" according to this invention includes in particular any type of preferably horizontal channels in a body, existing or to be created, in particular ground channels including bore holes in soil and rock, underground cables and underground or above-ground pipelines and water channels that can be manufactured or installed using a corresponding percussion boring device.

The terms "connecting section" and "joint" comprise the formation of a movable or hinged connection of the two sections of the control bushing, which permits movement of the two sections relative to each other, in particular triaxial, biaxial or uniaxial motion, in particular a pivoting movement of the two sections relative to each other being possible.

In a preferred embodiment, the connection is formed by means of a connecting section and/or the joint between a head section and a main body section of the control bushing. The main body section of the control bushing can at least in part abut the guide tube. The head section of the control bushing is, at least at the end, i.e. spaced apart from the movable connection, formed spaced apart from the guide tube and is not supported on the guide tube at the end region of the head section of the control bushing, but the impact piston and the head section of the control bushing form guide surfaces relative to each other, along which the impact piston can be axially displaced relative to the control bushing.

In a preferred embodiment the two sections of the control bushing have different outer diameters and in particular different inner diameters. The inner diameter of a section, in particular of the main body section, is adjusted to correspond to the outer diameter of the guide tube to be axially displaceable relative thereto. The outer diameter of the guide tube largely corresponds to the inner diameter of the first section, in particular of the main body section. The outer diameter of the first section, in particular of the main body section, is configured to prevent any contact with the impact piston. The first section, in particular the main body section has guide surfaces for the relative guiding of the first section on the guide tube. The inner diameter of the second section, in particular of the head section, is configured to prevent any contact in the end region of the second section with the guide bushing. The outer diameter of the second section, in particular of the head section, is adapted to an inner diameter of the impact piston to form guide surfaces for the axial movability of the impact piston relative to the control bushing. Both sections may be directly or indirectly interconnected by means of the movable connection—having the elastic connecting section and/or the joint.

In a preferred embodiment, the two sections of the control bushing on the guide tube are pivotable relative to each other. In particular, the section facing the impact piston can be pivotable against the other of the two sections. It can be provided that one of the sections, which can be pivoted against the other, can also be pivotable relative to the guide tube, provided the other of the two sections is axially displaceably fixedly mounted on the guide tube.

In a preferred embodiment, the elastic connecting section and/or a segment of the joint at least partly abut(s) the guide tube and is guided axially displaceably together with the control bushing relative to the guide tube to form a bearing for one of the sections, by means of which one of the sections can get an additional degree of freedom in relation to the guide tube.

In a preferred embodiment, the elastic connecting section and/or the joint has a ring shape having an L-shaped cross-section, so that, due to the geometric design, one of the two sections can more easily pivot.

In a preferred embodiment, the elastic connecting section comprises an elastically deformable plastic material, which can in particular be dimensionally stable. The elastic connecting section can comprise an elastomer or an elastomeric material or an elastic polymer, for instance rubber. The elastic connecting section may also—alternatively or additionally—comprise a polyurethane. The term "comprising" covers the collective meaning of the terms "to have" and "to consist of", so that in the one case, in addition to the one material or chemical compound specified, other materials or chemical compounds may exist and in the other case there is only the pure material with the exception of unavoidable contamination.

In a preferred embodiment, the guide tube has a stop, wherein the control bushing has a correspondingly designed counter element, which abuts the stop of the guide tube in one of the switching positions. In particular, the counter-element can be formed on the section and be connected thereto that is pivotable relative to the guide tube. This can be used to enable bringing the control bushing into a switching position defined by the stop and the counter-element.

In a preferred embodiment, an annular space is formed between the guide tube and a ring member, which is arranged in particular fixed to the guide tube. The annular space is at least partially frontally covered by the control bushing and is connected to a control line to which a fluid pressure can be applied. Pressure can be applied to the annular space by means of the control line to extract the control bushing out of the annular space. This way, switching is possible by simple means. The fluid can be either a pressurized gas, in particular compressed air, or a liquid, i.e. the switching can be conducted pneumatically or hydraulically from the switching position before extending the control bushing from the annular space into the switching position, the annular space being extended from the control bushing. After venting the control line to a lower pressure, in particular atmospheric pressure, the operating pressure present at the control bushing causes the control bushing to be reset.

In a preferred embodiment, a vent hole is formed at the anterior of the two sections of the control bushing, in particular at the head section, adjacent to the movable connection, for achieving a pressure balance. The vent hole may be configured in the front section of the control bushing or in the movable connection. The pressure equalization can take place between the exterior space surrounding the head section and the space between the head section, the guide tube and a stop ring on the guide tube, which may in particular form an inner guide for the head section of the control bushing. In this way, the control bushing may be advanced unhindered. No pressure, which would counteract a forward movement of the control bushing, builds up in the space formed by the head section, the guide tube and the stop ring. Preferably, the vent hole in the rear region of the head section, i.e., adjacent to the movable connection, is formed in order to ensure ventilation along the entire displacement path of the head section of the control bushing to the guide tube and the guide tube is formed on the stop ring. In particular, the vent hole can be formed on or near the counter element of the head section, which can interact with a stop at the stop ring. The vent hole can intersect the counter element or be located adjacent to the counter element.

BRIEF DESCRIPTION OF THE DRAWINGS

The above statements, just as the following description of exemplary embodiments, do not constitute a relinquishment of specific embodiments of features.

The invention is explained in greater detail below based on an exemplary embodiment shown in the drawings.

In the drawings:

FIG. 1 shows partial sectional view of a percussion boring device;

FIG. 2 shows an enlarged view of the percussion boring device of FIG. 1 with extended control tube; and FIG. 3 shows the view in accordance with FIG. 2 with retracted control tube.

DETAILED DESCRIPTION OF PREFERRED EMBODIMENTS

Figure 1:
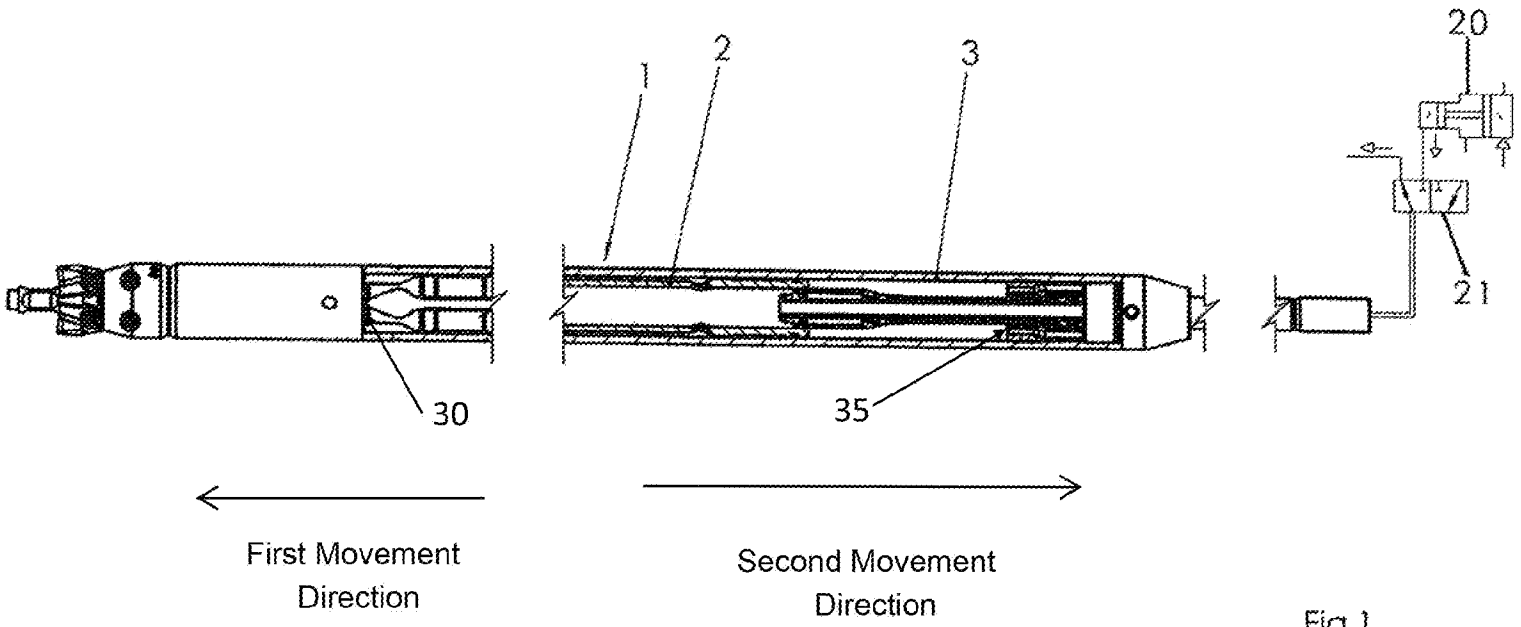

FIG. 1 shows a percussion boring device 1 for drilling into the ground. An end of the percussion boring device 1, FIG. 1 on the left shows a drilling head having a drill bit. The percussion boring device 1 has an impact piston 2 mounted within a casing 3. The impact piston 2 can be actuated for a cyclical reciprocation in the casing 3. In a first switching position, the impact piston 2 strikes a front impact surface 30, shown in FIG. 2, to actuate the percussion boring device 1 in a first movement direction (in the embodiment shown in FIG. 1 to the left). In a second switching position the impact piston 2 strikes a rear impact surface 35, shown in FIG. 2, to actuate the percussion boring device in a second movement direction (in the embodiment shown in FIG. 1 to the right).

To provide the pressure for reversing the direction of the impact piston 2, a pressure increasing means 20 is provided in the form of a pressure booster, which can be used to provide the pressure required for the reversal, in particular for extending the control bushing 4 relative to the guide tube 5. In relation to the feed, a directional control valve 21 is installed downstream of the pressure increasing means 20, which can be used in one position to bring the control bushing 4 into a switching position to increase pressure, and in another position to bring the control bushing 4 in a different switching position to decrease pressure.

For switching the movement directions, the percussion boring device 1 has a guide tube 5 fixed to the casing and a control bushing 4 axially displaceable on the guide tube 5. The impact piston 2 can be axially displaceable on the control bushing 4. In particular from FIG. 2 it can be gathered that the control bushing 4 temporarily engages with the impact piston 2 at the axial displacement.

The control bushing 4 has two sections 7, 8 that are configured as a head section 7 and the main body section 8, connected with each other by means of a movable connection. In exemplary embodiment illustrated in FIGS. 1 to 3, the movable connection 6 is designed as an elastic connecting section, which is configured to enable the two sections of the control bushing 4 to pivot relative to each other. The movable connection 6 is connected to the main body section 8 and the head section 7 encompasses the elastic connecting section.

The main body section 8 of the control bushing 4 abuts at least in part the guide tube 5. The head section 7 of the control bushing 4 is on the inside spaced apart from the guide tube 5. The inner diameter of the head section 7 of the control bushing 4 is, in particular at the position spaced from the main body section 8 end, larger than the outer diameter of the guide tube 5. On the end of the head section 7 adjacent the main body section 8, the head section 7 has a smaller inner diameter than at the end of the head section 7 spaced apart from the main body section 8.

A stop ring 12 having a stop for the control bushing 4 is connected to the guide tube 5. To this end, at the head section 7 of the control bushing 4 a counter element is configured corresponding to the stop, which abuts the stop of the guide tube 5 in the switching position of the control bushing 4 to the guide tube 5 shown in FIG. 2. The stop ring 12 can, with the outer circumference, be an inner guide for the head section 7 of the control bushing 4.

Figure 2:
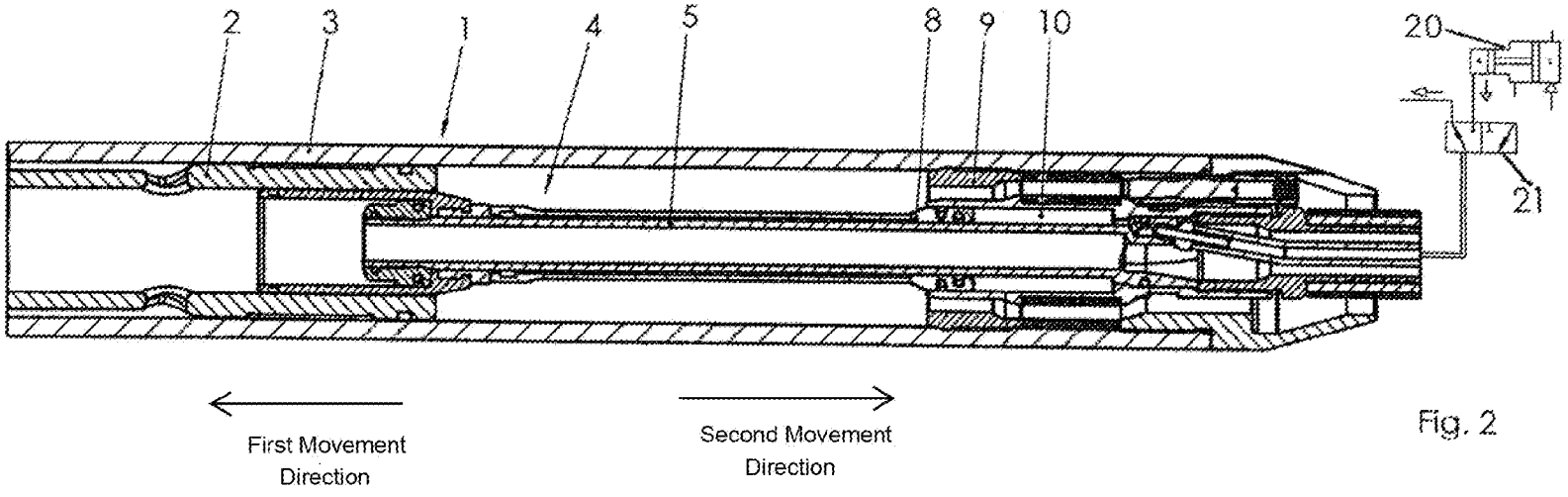

In FIG. 2 an annular space 10 is shown, which is formed between the guide tube 5 and an annular element 9, which is disposed fixed to the guide tube 5. The annular space 10 is at least partially frontally delimited by the control bushing 4 and is connected to a control line 11 to which a fluid pressure can be applied. Pressure can be applied to the annular space 10 by means of the control line 11 to extract the control bushing 4 out of the annular space 10. If the pressurization of the annular space 10 is terminated, the operating pressure present at the control bushing 4 effects a retraction or a resetting of the control bushing 4.

Figure 3:
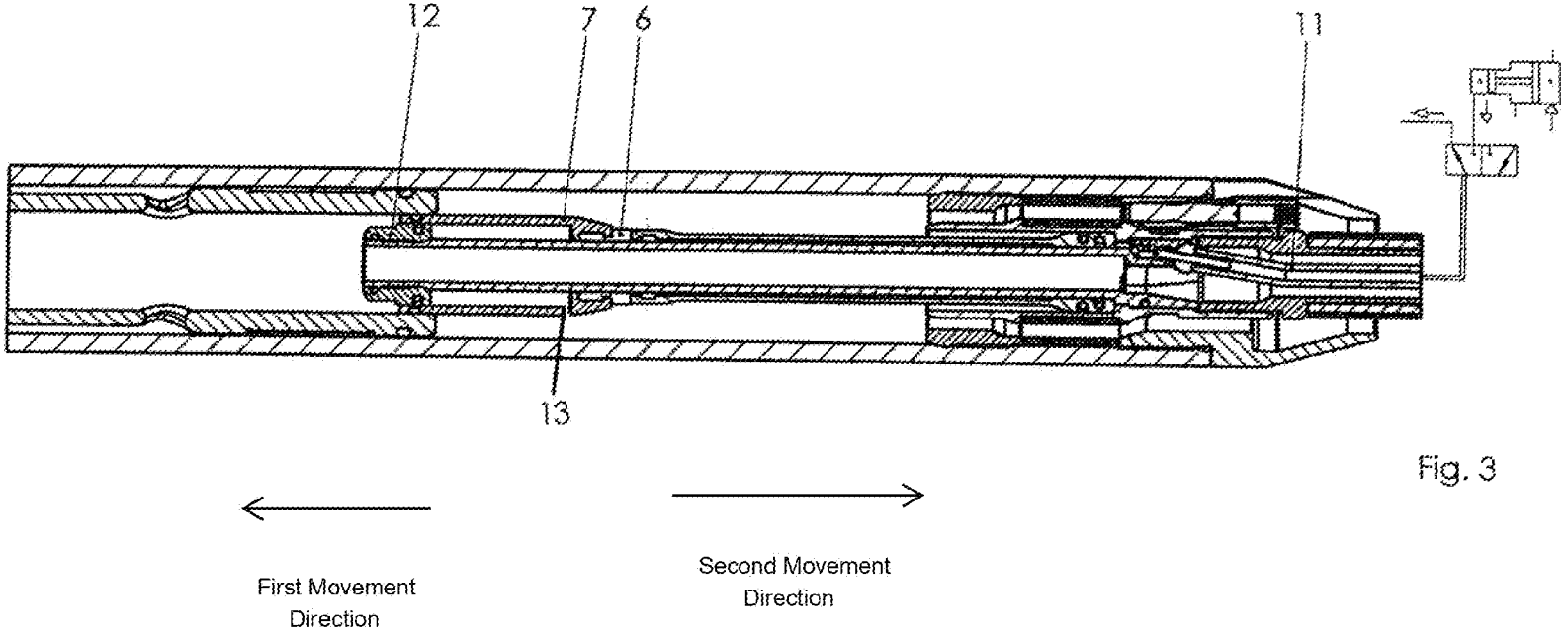

FIG. 3 shows by way of example also for FIG. 2 a vent hole 13, which is formed in the head section 7 of the control bushing 4 to achieve a pressure balance.

The invention claimed is:

1. A percussion boring device comprising:

a casing;

a guide tube fixed to the casing;

an impact piston configured to be actuated in a reciprocating manner within the casing by application of an operating pressure;

a control bushing axially displaceable on the guide tube to (i) a first switching position to actuate the percussion boring device in a first movement direction in which the impact piston strikes a front impact surface, and to (ii) a second switching position to actuate the percussion boring device in a second movement direction in which the impact piston strikes a rear impact surface, wherein the impact piston is axially displaceable on the control bushing;

a control pressure source fluidly coupled to the control bushing and configured to generate a high fluid pressure for axially displacing the control bushing to the first switching position to actuate the percussion boring device in the first movement direction, the high fluid pressure generated being higher than the operating pressure for moving the impact piston in the reciprocating manner in the first movement direction and the second movement direction, and a control valve configured to cause a pressure in a control pressure line to be reduced below the operating pressure to cause the operating pressure to displace the control bushing to the second switching position to actuate the percussion boring device in the second movement direction;

wherein, while the high fluid pressure for axially displacing the control bushing to the first switching position is applied to the control bushing, the control bushing is in the first switching position and the impact piston is configured to be moved by the operating pressure in the first movement direction;

wherein, while a pressure less than the operating pressure is applied to the control bushing, and the operating pressure is provided to the impact piston, the control bushing is in the second switching position and the impact piston is configured to be actuated by the operating pressure in the reciprocating manner in the second movement direction.

2. The percussion boring device according to claim 1, wherein an annular space is formed between the guide tube and an annular element, wherein the annular space is at least partially covered by the control bushing, and wherein the annular space is connected to a control line configured to receive the high fluid pressure generated by the control pressure source for axially displacing the control bushing to the first switching position to actuate the percussion boring device in the first movement direction.

3. The percussion boring device according to claim 1, wherein, for axially displacing the control bushing to the first switching position to actuate the percussion boring device in the first movement direction, the high fluid pressure generated by the control pressure source is 5 to 25 bar.

4. The percussion boring device according to claim 1, wherein the control valve comprises a multi-position directional control valve which includes at least one position configured to apply the high fluid pressure generated by the control pressure source to the control bushing for axially displacing the control bushing to the first switching position to actuate the percussion boring device in the first movement direction and a second position configured to vent the control pressure line to cause the operating pressure to displace the control bushing to the second switching position to actuate the percussion boring device in the second movement direction.

5. The percussion boring device according to claim 1, further comprising a pressure reducing valve, wherein the control pressure source is connected to the impact piston and the pressure reducing valve is connected between the control pressure source and the impact piston.

6. The percussion boring device according to claim 1, wherein operation of the percussion boring device in the first movement direction is based upon applying the high fluid pressure from the control pressure source to axially displace the control bushing to the first switching position for movement in the first movement direction; and application of the operating pressure to the impact piston for actuation of the impact piston in the reciprocating manner within the casing of the percussion boring device in the first movement direction.

7. A percussion boring device comprising:

a casing;

a guide tube fixed to the casing;

an impact piston configured to be actuated in a reciprocating manner within the casing;

a control bushing axially displaceable on the guide tube to (i) a first switching position to actuate the percussion boring device in a first movement direction in which the impact piston strikes a front impact surface, and to (ii) a second switching position to actuate the percussion boring device in a second movement direction in which the impact piston to strike a rear impact surface, wherein the impact piston is also axially displaceable on the control bushing;

a control line operatively coupled to the control bushing, and a control valve;

a control pressure source, in fluid communication with the control valve, operative to generate a high fluid pressure for axially displacing the control bushing to the first switching position for movement of the percussion boring device in the first movement direction, the high fluid pressure generated by the control pressure source being higher than an operating pressure for actuating the impact piston in the reciprocating manner in the first movement direction and the second movement direction; and wherein the control valve in a first position is operative to apply a pressure lower than the operating pressure to the control bushing to place the control bushing in the second switching position for movement of the percussion boring device in the second movement direction, and wherein the control valve in a second position is operative to apply the high fluid pressure from the control pressure source to place the control bushing in the first switching position for movement of the percussion boring device in the first movement direction.

8. The percussion boring device according to claim 7, wherein an annular space formed between the guide tube and an annular element, wherein the annular space is at least partially covered by the control bushing, and wherein the annular space is connected to the control line and is configured to receive the high fluid pressure for axially displacing the control bushing to the first switching position for movement of the percussion boring device in the first movement direction.

9. The percussion boring device according to claim 7, wherein, for axially displacing the control bushing to the first switching position to actuate the percussion boring device in the first movement direction, the high fluid pressure generated by the control pressure source is 5 to 25 bar.

10. The percussion boring device according to claim 7, wherein operation of the percussion boring device in the first movement direction is based upon application of the high fluid pressure from the control pressure source to axially displace the control bushing to the first switching position for operation in the first movement direction, and application of the operating pressure to the impact piston for movement of the percussion boring device in the first movement direction.

11. A method for operating a percussion boring device including an impact piston in a forward movement direction and a reverse movement direction, the forward movement direction configured to strike a front impact surface to actuate the percussion boring device and the reverse movement direction configured to strike a rear impact surface to actuate the percussion boring device, and a control bushing axially displaceable on a guide tube for switching a movement direction of the impact piston, responsive to movement of the control bushing, comprising:

applying an operating pressure to the impact piston to actuate the impact piston in a reciprocating manner within a casing in one of the forward movement direction and the reverse movement direction;

applying, by a control pressure source operatively coupled with the control bushing, one of a first fluid pressure and a second fluid pressure for axially displacing the control bushing on the guide tube and bringing the control bushing into one of (i) a first switching position in which the impact piston strikes the front impact surface to actuate the percussion boring device in the forward movement direction by application of the first fluid pressure and (ii) a second switching position in which the impact piston strikes the rear impact surface to actuate the percussion boring device in the reverse movement direction by application of the second fluid pressure, wherein application of the first fluid pressure is selected via a control valve with a selectable position configured to cause a fluid pressure in a control pressure line to be increased above the operating pressure to cause the operating pressure to displace the control bushing to the first switching position to actuate the percussion boring device in the forward movement direction;

wherein the second fluid pressure is lower than an operating pressure for moving the impact piston in the forward movement direction and the second movement direction.

12. The method of claim 11, wherein applying the one of the first fluid pressure and the second fluid pressure for axially displacing the control bushing comprises applying the one of the first fluid pressure and the second fluid pressure to an annular space configured for receiving the one of the first fluid pressure and the second fluid pressure, the annular space formed between the guide tube and an annular element at least partially covered by the control bushing.

13. The method of claim 11, wherein applying the first fluid pressure by the control pressure source further comprises selecting a position of a multi-position directional control valve operatively coupled to the control pressure source and the control bushing to apply the first fluid pressure to the control bushing to bring the control bushing into the first switching position to actuate the percussion boring device in the forward movement direction.

14. The method of claim 11, wherein operation of the percussion boring device in the forward movement direction is based upon applying the fluid pressure higher than the operating pressure used for moving the impact piston from the control pressure source to axially displace the control bushing to the first switching position for movement in the forward movement direction; and application of the operating pressure to the impact piston for actuation of the impact piston in the reciprocating manner within the casing of the percussion boring device in the forward movement direction.

* * * * *